United States Patent [19]

Mullich et al.

[11] Patent Number: 4,489,576

[45] Date of Patent: Dec. 25, 1984

[54] DEADBOLT ASSEMBLY

[75] Inventors: Richard O. Mullich, Burbank; Ray Dushane, Fullerton, both of Calif.

[73] Assignee: TRE Corporation, Los Angeles, Calif.

[21] Appl. No.: 589,349

[22] Filed: Mar. 14, 1984

Related U.S. Application Data

[60] Division of Ser. No. 414,293, Sep. 2, 1982, Pat. No. 4,446,707, which is a continuation of Ser. No. 190,354, Sep. 24, 1980, abandoned.

[51] Int. Cl.[3] ..... E05B 65/06

[52] U.S. Cl. ..... 70/134; 70/370; 70/380; 70/461; 292/143; 292/DIG. 60

[58] Field of Search ..... 70/129, 134, 370, 379, 70/380, 461, 143; 292/140, 143, 173, DIG. 60

[56] References Cited

U.S. PATENT DOCUMENTS

| | | | |
|---|---|---|---|
| 1,207,465 | 12/1916 | Augenbraun | 70/370 |
| 1,875,396 | 9/1932 | Schlage | 70/370 |
| 4,272,974 | 6/1981 | Hennessy | 70/134 X |
| 4,301,667 | 11/1981 | Best et al. | 70/380 |

*Primary Examiner*—Gary L. Smith
*Assistant Examiner*—Thomas J. Dubnicka
*Attorney, Agent, or Firm*—Spensley, Horn, Jubas & Lubitz

[57] ABSTRACT

A lock assembly including a novel retaining strap for securing a lock cylinder within the assembly. The lock assembly is designed so that one of two different degrees of bolt extension can be chosen during assembly of the device. In addition the assembly incorporates a dowel pin to increase the strength of the joint between the lock bolt and a lock bolt extension connected to the lockbolt.

4 Claims, 8 Drawing Figures

DEADBOLT ASSEMBLY

This is a division of application Ser. No. 414,293, now U.S. Pat. No. 4,446,707 filed on 9/2/82, which is a continuation of Ser. No. 190,354 filed on 9/24/80, now abandoned.

BACKGROUND OF THE INVENTION

1. Field of the Invention

This invention relates to deadbolt and similar lock assemblies. More particularly, this invention relates to a deadbolt assembly incorporating an improved means of lock cylinder retention within the assembly and means for facilitating one of two different deadbolt extensions during manufacture of the lock assembly.

2. Description of the Prior Art

A typical deadbolt lock unit incorporates exterior and interior housings, within which are carried lock cylinders. Each of the lock cylinders includes a driver bar which extends from the rear thereof. The driver bar is coupled to a deadbolt assembly located between the interior and exterior housings. Rotation of the driver bar causes extension or retraction of the lock bolt. Prior art lock devices of this type are disclosed in U.S. Pat. Nos. 4,073,172 to Schlage, 3,768,284 to Kent, et al., and 3,628,356 to Deahl. Many lock assemblies incorporate a drill resistant cap which extends through an opening in the housing and covers the lock cylinder so as to protect it against tampering. The cap includes an opening which exposes the keyway of the lock cylinder. In addition to the above patents, such caps are disclosed in U.S. Pat. Nos. 1,488,925 to Hurd, 1,411,898 to Augenbraun, U.S. Pat. No. Re. 16,123 to Schonwald and U.S. Pat. No. 2,126,291 to Jacobi.

Generally, the lock cylinder assembly is positioned within a bore within the housing, and some type of securement device is required to keep the lock cylinder both axially and longitudinally aligned. In the Schlage patent, a separate retaining ring utilized hold the cylinder cap at the front of the housing and a loop support surrounds the rear of the cylinder and is attached to the housing. Although the loop support provides adequate retention and alignment of the lock cylinder, it increases the difficulty of assembly since the loop must be passed around the rear of the lock cylinder.

Another problem which has been addressed in the present invention concerns the degree of deadbolt extension which is available with a particular lock unit. Typically, the coupling mechanism between the driver bar of the lock cylinder and the lock bolt is designed so that the lock bolt will extend a predetermined fixed amount each time the deadbolt unit is locked. Different degrees of extension are used for different applications, however, with 1" and ⅝" extensions being typical. When the deadbolt unit is unlocked, the lockbolt retracts so that it fits flush with a strikeplate. The amount of extension is controlled by the design of the coupling mechanism, and has generally required a different design to accomplish different degrees of extension.

SUMMARY OF THE INVENTION

The present invention is directed to a deadbolt lock unit which incorporates a novel retention and alignment device which accurately aligns the lock cylinder without requiring a loop that extends around the cylinder. In addition, the present invention incorporates a deadbolt assembly in which one of two different deadbolt extensions may be chosen during assembly of the device.

The housing contains a cylindrical bore whose diameter is somewhat larger than the diameter of the lock cylinder. A rectangular bore extends radially upward from the side of the cylindrical boar and provides a space for cylinder pins which are a part of the lock cylinder assembly. The cylindrical body of the lock cylinder includes a generally rectangular radial extension for holding the cylinder pins and at least one additional extension which operates to align the lock cylinder within the bore of the housing. The extension includes a first surface which fits within a longitundinal groove formed within the bore and a second surface which extends toward the inside of the unit beyond the groove. The lock cylinder is held within the bore by means of a strap whose ends are secured to first and second mounting surfaces on the housing. The bottom surface of one end of the strap contacts the second surface of the extension of the lock cylinder so as to sandwich the extension between the strap and the groove. The other end of the strap includes a downwardly extending flange having a curved surface which abuts the curved surface of the lock cylinder and positions the lock cylinder so that the extension is wedged in between the groove and the lower surface of the first side of the strap. The strap includes a middle portion which spans the rectangular extension of the lock cylinder and tightly abuts the end of the rectangular portion. The middle portion serves to tightly bias the front of the lock cylinder against the cylinder cap, thereby maintaining the longitudinal position of the lock cylinder. Thus, the present invention provides a retaining member which serves to accurately align the lock cylinder without requiring a loop which extends entirely around the lock cylinder.

In order to facilitate manufacture of the deadbolt lock assembly having one of two different lock bolt extensions without requiring any different components, a specially designed bolt housing and bolt assembly are employed. The lockbolt includes an extension which is slideable within the housing. A cam is located within the housing which translates rotational motion of the driver bar of the lock cylinder into linear motion of the lockbolt and extension. The cam is coupled to the extension by means of a pin which passes through one of two longitudinally offset openings in the extension. The pin also rides within one of two pair of longitudinal parallel slots located on the bolt housing. The slots are of unequal length and serve to control the amount of travel of the pin and therefore the bolt and extension. By assembling the unit so that the pin passes through a first pair of slots and corresponding opening in the bolt extension, a first degree of bolt extension will be provided, whereas by passing the pin through the second pair of slots and their associated opening in the dead bolt extension, a second amount of bolt extension will be provided. Therefore, during assembly of the unit one of two different bolt extensions can be chosen simply by placing the pin through one or the other of the slotpairs. This eliminates the need to manufacture two completely different deadbolt assemblies in order to provide different bolt extensions.

DESCRIPTION OF THE PREFERRED EMBODIMENT

Figure 1:
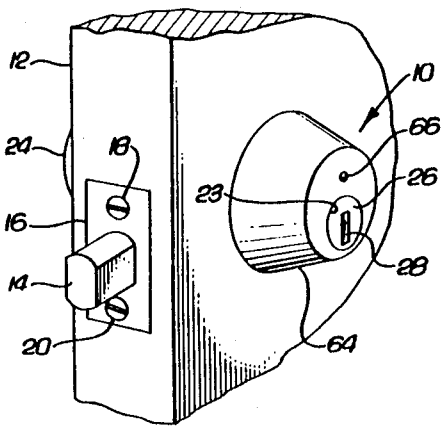
FIG. 1 is a perspective view showing the deadbolt unit of the invention mounted in a door.
Figure 2:
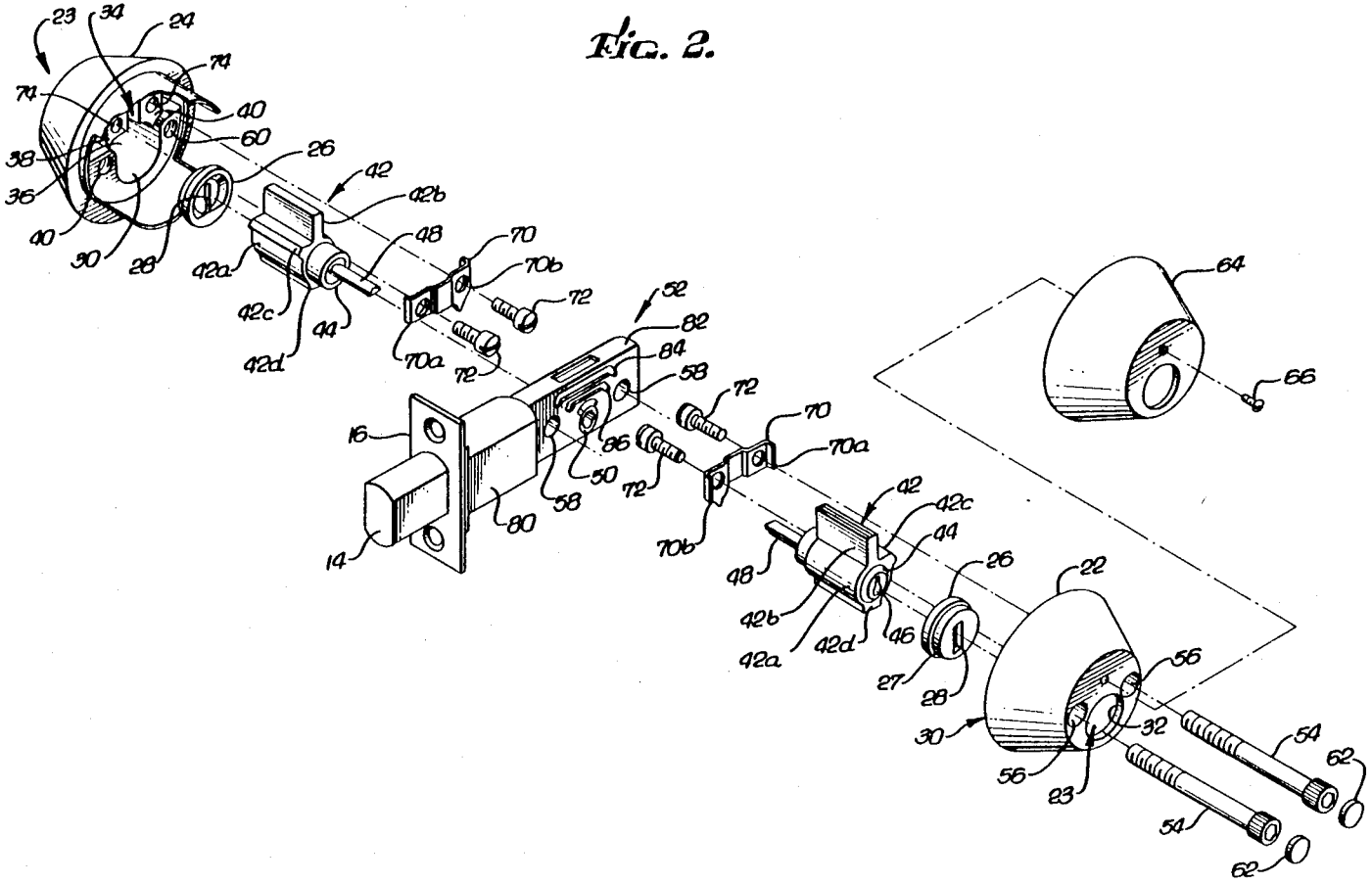
FIG. 2 is an exploded perspective view of the deadbolt assembly.

Referring to FIGS. 1 and 2, the deadbolt unit 10 of the present invention is shown assembled in a door 12. The unit 10 includes a lockbolt 14 which extends from an opening in a faceplate 16 that is secured to the door 12 by means of a pair of screws 18 and 20. Interior and exterior housings 22 and 24 are located on either side of the door 12. Each housing includes an opening 23 through which is exposed a drill resistant cylinder cap 26 having a keyway opening 28. The cylinder cap 26, which in the preferred embodiment is made of press sintered steel, has a stepped outer surface 27. The smaller diameter portion of the cap extends through the opening 23 in the housing 22. Located behind the opening 23 is a generally cylindrical bore 30 which is concentric with the opening 23 and whose diameter is slightly larger than that of the opening 23 to thereby form a shoulder 32 on the inside of the opening 23. The stepped surface 27 of the cylinder cap 26 abuts the shoulder 32. A generally rectangular bore 34 extends radially upward from the top of the cylindrical bore 30. A groove 36 is also formed in the surface of the bore 30 spaced slightly from the bore 34. A pair of mounting surfaces 38 and 40 parallel to the front of the housing are located on either side of the bore 34.

A pair of lock cylinder assemblies 43 each include a cylindrical body 42*a* having a radial extension 42*b* for carrying cylinder pins (not shown), a positioning extension 42*c* and a lower extension 42*d* opposite the extension 42*b*. A cylinder core 44 having a keyway 46 is carried within the body 42. A drive bar 48 extends from the rear of the cylinder core 44. The drive bar has a semicircular cross-section with flattened ends. The drive bars 48 pass through a hub 50 contained in a deadbolt assembly 52. When a key is inserted through the keyway 28 and into the keyway 46 of the lock cylinder assembly 42 and rotated, the drive bar 48 will rotate, thereby imparting rotation to the hub 50 and retracting the bolt 14. The coupling between the hub 50 and bolt 14 in the deadbolt assembly 52 will be described subsequently.

As can be seen in FIG. 2, the interior housing 22 is connected to the exterior housing 24 by means of a pair of bolts 54. The bolts 54 pass through openings 56 in the interior housing, through openings 58 in the deadbolt assembly 52 and into threaded holes 60 in the exterior housing 23. In order to resist tampering, the heads of the bolts 54 may be covered with caps 62. A decorative coverplate 64 may be secured over the outer surface of the interior housing 22 by means of a small screw 66 in order to cover the caps 62.

Each of the lock cylinder assemblies 42 is secured within its respective housing 22 and 24 by means of a retaining strap 70, which is one of the important features of the present invention. The retaining strap 70 is secured to the mounting surfaces 38 and 40 by means of a pair of bolts 72 which are threaded into openings 74 located on the mounting surfaces 38 and 40. The central portion of the strap 70 contacts the rear surface of the cylinder pin extension 42*b* and biases the lock cylinder assembly 42 tightly within the housing and against the rear surface of the cylinder cap 26,. The strap thus serves to securely longitudinally position the lock cylinder assembly 42 within the housing. As can be seen more clearly in FIG. 3, the inside surface of the cylinder cap 26 has a frusto-conical portion 26*a* which includes a flat section 26*b*, and the front surface of the cylinder core 44 has a corresponding frusto-conical porton 44*a* which includes a flat section 44*b* which corresponds to the flat 26*b*. When the lock unit is assembled, the flat 26*b* is aligned with the flat 44*b*, thereby aligning the keyway 28 with the keyway 46. The conforming flat sections ensure that the keyways of the cylinder cap 26 and core 44 will always be in register.

Figure 4:
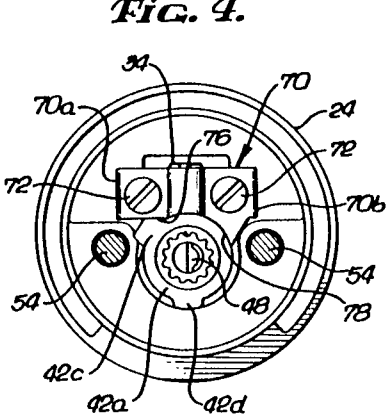
FIG. 4 is a rear plan view showing a lock cylinder located within the cylinder housing and held in place by a retaining strap.
Figure 3:
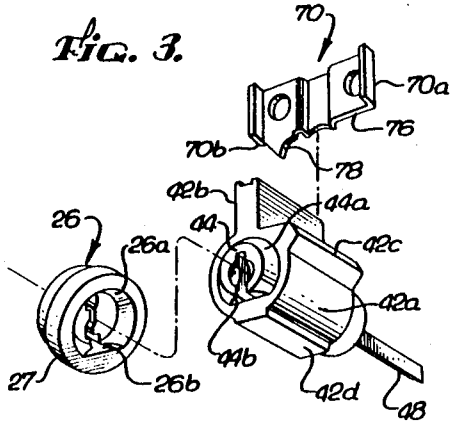
FIG. 3 is a perspective view showing the lock cylinder, cylinder cap and retaining strap of the invention.

Referring now to FIGS. 3 and 4, the retaining strap 70 includes a flat surface 76 on the lower edge of a first end 70*a* and a flange 78 which extends downward from a second end 70*b*. The upper surface of the extension 42*c* is perpendicular to the extension 42*b*, and the surface 76 contacts the top of the extension 42*c*. The extension 42*c* is thus sandwiched between the surface 76 and the groove 36. The flange 78 includes a curved surface which conforms to and is biased against the outer curved surface of the cylinder body 42*a*. The flange 78 serves to horizontally position the lock cylinder assembly so that the extension 42*c* is wedged tightly between the surface 76 and the groove 36. The combination of the groove 36, extension 42*c*, mounting surface 76 and flange 78 serve to prevent any horizontal axial motion of the lock cylinder assembly 42. In addition to longitudinally positioning the lock cylinder assembly, the bias provided by the middle portion of the retaining strap 70 serves to prevent any vertical axial motion of the lock cylinder assembly 42. Thus, the design of the retaining strap, lock cylinder body and bore 30 facilitates maintenance of both axial (horizontal and vertical) and longitudinal alignment of the lock cylinder assembly without requiring any type of loop which passes completely around the cylinder body. The lower extension 42*d* may also be used to help position the lock cylinder (by contacting the bore) but it is not required in order to provide accurate alignment.

Figures 5, 6, 7:
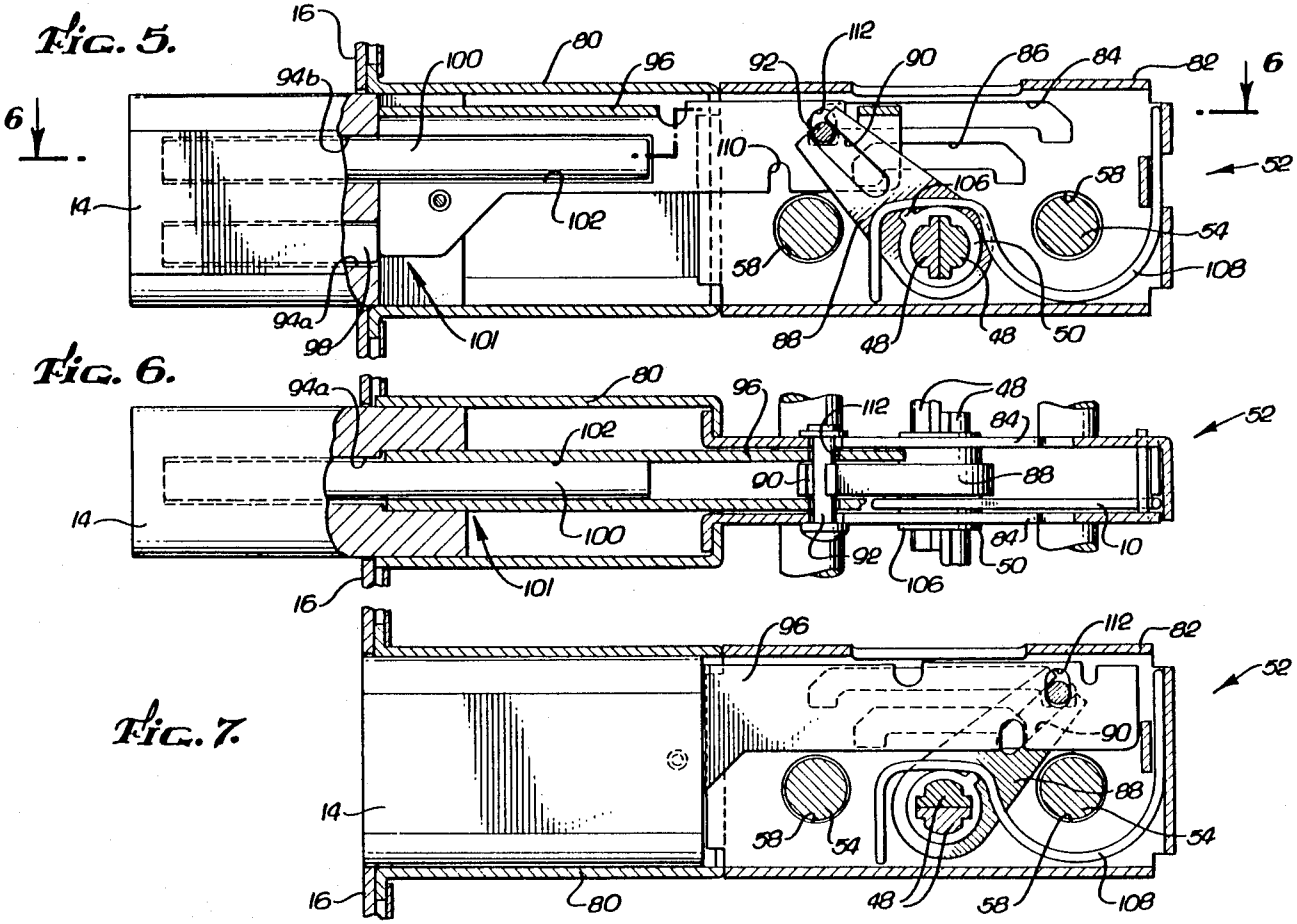
FIG. 5 is a side section view of the lockbolt assembly of the present invention assembled to have a first degree of lock bolt extension.
FIG. 6 is a top section view of the bolt and extension of the present invention.
FIG. 7 is a side section view of the lockbolt assembly shown in a position which corresponds to retraction of the latchbolt.

Referring now to FIGS. 2, 5 and 6, the deadbolt assembly 52 includes a latchcase 80 to which is connected to a hollow latchcase extension 82. The extension 82 includes a relatively long slot 84 and short slot 86 on each side of the case extending parallel to each other along the length of the case. A cam or lever arm 88 having a slot 90 is integral with the hub 50 and rotates therewith. During assembly, a pin 92 is passed through the slot 90 and either the slots 84 or 86. The pin 92 serves to couple the arm 88 to a bolt extension 96 which is connected to the bolt 14. The bolt 14 is slideable within the latchcase 80 and the bolt extension 96 is slideable within the latchcase 80 and the case extension 82.

A dowel 98 is positioned within a bore 94*a* in the bolt and serves to resist attempts at intrusion by sawing through the bolt. The dowel pin 98 is made of a hardened material which resists sawing and is also freely rotatable within the bore 94*a* so as to rotate when contacted by a saw to further increase cutting difficulty. The use of such pins is well known in the art. A second dowel pin 100 is located within a bore 94*b* in the bolt. The dowel 100 also extends into a groove 102 within the bolt extension 96, thereby serving to strengthen the joint 101 between the bolt 14 and bolt extension 96. The bolt extension 96 has a U-shaped cross-section and a groove 102 is formed on each side of the inner surface of the bolt extension. With prior art designs, an impact on the door will often cause bending at the joint 101 between the bolt extension and the bolt. When this occurs, even if the lock is not completely broken the bending distorts the bolt 94 such that it cannot be retracted by the application of a normal amount of force (such as would be applied by hand when turning a key). Because of the distortion at the joint 101, the bolt 14 will not have a straight path into the latch case 80 and will scrape the wall of the case. Additional force (such as could be supplied by the use of pliers) will then be required to retract the bolt. The use of the lengthened dowel pin 100 substantially reduces this bending problem.

Figure 8:
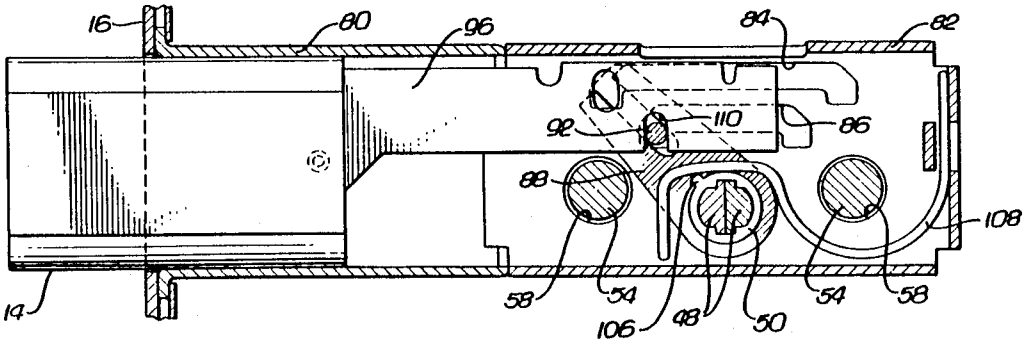
FIG. 8 is a side section view of the lockbolt assembly assembled to have a second degree of lock bolt extension.

The bolt extension 96 includes a lower notch 110 and an upper opening 112 which is longitudinally offset from the notch 110. When the pin 92 is positioned within the slots 84, it will pass through the opening 112 (as shown in FIG. 5). When such is the case, the pin 92 will be carried relatively high within the slot 90 of the arm 88. On the other hand, when the unit is assembled so that the pin 92 passes through the slot 86, it will be coupled to the bolt extension 96 by means of the notch 110 and will ride relatively low in the slot 90 (as shown in FIG. 8). The degree of extension of the bolt 14 is controlled by the extent of movement of the pin 92. The amount of pin movement is in turn a function of whether the pin 92 is located to pass through the slots 84 or the slots 86. When the pin is located to pass through the slots 84, it is coupled to the bolt extension 96 at the opening 112. The combination of the long slot 84 and longitudinal position of the opening 112 on the extension 96 enables a relatively long (e.g. 1") bolt extension to be achieved. In contrast, when the pin is located to pass through the slots 86, it is coupled to the bolt extension 96 by means of the notch 110, thereby resulting in a lesser amount of bolt extension (e.g. $\frac{5}{8}$"). The ends of the slots 84 and 86 are radially aligned with each other in relation to the hub 50, thereby causing the amount of rotation of the hub 50 to be the same irrespective of whether the pin 92 is positioned in the slots 84 or the slots 86. The offset arrangement of the notch 110 and opening 112 in the bolt extension 96 facilitates different degrees of bolt extension for equal amounts of hub rotation. In addition, as shown in FIG. 7, the bolt 14 will be retracted so that it is flush with the edge of the latchcase 80 whether the pin 92 is carried in the slots 84 or the slots 86.

As can be seen in FIGS. 3, 7 and 8, the hub 50 includes a projection 106 which is aligned with the slot 90 of the arm 88. A downward bias is placed upon the arm 106 by means of a hold-down spring 108. The spring 108 serves to bias the arm 88 to maintain it in a fully rotated position. The ends of the slots 84 and 86 are notched and, in conjunction with the spring force, serve to prevent tampering by attempts to slide the bolt 44 from an extended to retracted position. Spring mechanisms for this purpose are known in the art.

In summary, the present invention is directed to a deadbolt assembly which provides a novel means for mounting a lock cylinder assembly within a housing, a strengthened joint between a bolt and bolt extension, and a mechanism which facilitates the assembly of a unit having one of two different degrees of bolt extension without requiring any additional components. Although the invention has been described in terms of a single embodiment, it should be recognized that variations and modifications will readily occur to those skilled in the art. For example, a lock unit having a single lock cylinder, which would actuated from the interior by a knob rather than a key, could advantageously employ the present invention. Therefore, it is intended that the claims be interpreted to cover such modifications and variations.

We claim:

1. A lock assembly comprising:

an exterior housing havng a circular opening on the front surface thereof, a substantially cylindrical bore concentric with the opening and having a diameter slightly greater than the opening so as to form a shoulder therebetween, a substantially rectangular bore extending radially from the cylindrical bore and a longitudinal groove formed in the cylindrical bore slightly offset from the rectangular bore, said housing including a first mounting surface adjacent one side of the rectangular bore and a second mounting surface adjacent the other side of the rectangular bore;

a hardened cylinder cap having a stepped peripheral surface, said cap being located within the cylindrical bore and extending through the opening, whereby the stepped surface abuts the shoulder;

a lock cylinder assembly including a cylindrical body disposed within the cylindrical bore, a first radial extension which is disposed within the rectangular bore and carries a plurality of cylinder pins and an alignment extension having a first surface which abuts the portion of the longitudinal groove and a second surface which is substantially adjacent to and extends inward beyond the first mounting surface of the housing; and a restraining strap secured to the first and second mounting surfaces, said restraining strap including a middle portion which contacts the rear surface of the first extension of the lock cylinder assembly and biases the lock cylinder assembly tightly against the inside surface of the cylinder cap, a downwardly extending flange adjacent to the end of the strap secured to the second mounting surface and having a curved lower surface which abuts the curved surface of the cylindrical body to bias the alignment extension into the groove, the lower surface of the end of the strap secured to the first mounting surface abutting the second surface of the second extension and forcing the first surface of the second extension against the groove, whereby the lock cylinder assembly is accurately and securely positioned both longitudinally and axially within the housing.

2. A lock assembly according to claim 1 wherein the cylinder body further includes a third extension generally opposite the first extension, the third extension abutting the surface of the cylindrical bore to further aid in the positioning of the lock cylinder assembly within the housing.

3. A lock assembly according to claim 1 wherein the lock cylinder assembly includes a drive bar extending from the rear portion thereof, and further including a deadbolt assembly coupled to said drive bar, said deadbolt assembly comprising:

a latchcase including a latchcase extension, said latchcase extension including upper and lower unequal length pairs of slots parallel to each other extending along the length of the latchcase;

a lockbolt slidable within the latchcase;

a lockbolt extension attached to the lockbolt and slidable within the latchcase and latchcase extension, said lockbolt extension and having a U-shaped cross-section upper and lower longitudinally offset openings near the free end thereof;

a hub rotably secured within the latchcase extension, said hub including an integral slotted arm and being rotated by means of said drive bar; and a pin passing through the slot in the arm, one of the openings in the bolt extension and one of said upper and lower slot pairs, whereby as the cam is rotated the pin will slide within the slots, engage the bolt extension and move the lockbolt, wherein the lockbolt will extend a first distance if the pin is carried in the upper slots and a second distance if the lower slots.

4. The lock assembly of claim 3 further including a dowel extending from the interior of the lockbolt into the interior of the bolt extension to thereby strengthen the joint therebetween.

* * * * *